US008276834B2

(12) United States Patent
Qiu et al.

(10) Patent No.: US 8,276,834 B2
(45) Date of Patent: Oct. 2, 2012

(54) MULTI-FUNCTION SHOWER HEAD

(75) Inventors: Jiasen Qiu, Guangdong (CN); Aping Zhou, Guangdong (CN); Yao Lu, Guangdong (CN); Weijin Huang, Guangdong (CN); Yuansheng Chen, Guangdong (CN)

(73) Assignee: Globe Union Industrial Corp., Taichung (TW)

( * ) Notice: Subject to any disclaimer, the term of this patent is extended or adjusted under 35 U.S.C. 154(b) by 585 days.

(21) Appl. No.: 12/577,510

(22) Filed: Oct. 12, 2009

(65) Prior Publication Data

US 2011/0084153 A1 Apr. 14, 2011

(51) Int. Cl.
*A62C 31/00* (2006.01)

(52) U.S. Cl. ..... 239/449; 239/443; 239/558; 239/581.1; 239/501; 239/499

(58) Field of Classification Search ..... 239/394, 239/442–449, 558–561, 581.1, 499, 501
See application file for complete search history.

(56) References Cited

U.S. PATENT DOCUMENTS 5,577,664 A * 11/1996 Heitzman ..... 239/99
7,520,448 B2 * 4/2009 Luettgen et al. ..... 239/463
7,740,186 B2 * 6/2010 Macan et al. ..... 239/11

* cited by examiner

*Primary Examiner* — Dinh Q Nguyen

(57) ABSTRACT

A multi-function shower head provides three water flower levels in response to three watering modes and comprises a low-flow controlling valve and a water flower generator such that the water flow passes through water flower generator to result in a centrifugal force, and then passes through a plurality of tunnels and a path to spray water, obtaining low-flow and strong water flower. Thereby, a water saving and strong flowing purpose of the shower head is achieved.

20 Claims, 13 Drawing Sheets

MULTI-FUNCTION SHOWER HEAD

BACKGROUND OF THE INVENTION

1. Field of the Invention

The present invention relates to a multi-function shower head that provides three water flower levels in response to three watering modes to obtain low-flow and strong water flower, hence a water saving and strong flowing purpose of the shower head is achieved.

2. Description of the Prior Art

Conventional multi-function shower heads, such as a wall type shower head, include a spherical knob to be connected to a water feeding pipe so that a user can adjust a watering angle based on requirement.

The above-mentioned shower head has level adjusting function so that water flows through different level of an inlet, an external passageway, chambers, and outlets to generate water flowers in different watering modes, such as jetted, massaged, sprayed, and fogged water flowers.

The conventional multi-function shower heads includes a standard flow controlling valve installed in the spherical knob to control the flow amount at 2.5 GPM/min, however such a sole standard flow amount can not satisfy environmental friendly purpose.

As the flow amount of the standard flow controlling valve is less then 1.5 GPM/min, the sprayed water flower is too small to generate strong water flower.

The present invention has arisen to mitigate and/or obviate the afore-described disadvantages.

SUMMARY OF THE INVENTION

The primary object of the present invention is to provide a multi-function shower head which obtains low-flow and strong water flower. Thereby, a water saving and strong flowing purpose of the shower head is achieved.

A multi-function shower head according to a preferred embodiment of the present invention comprises a holder including an inflow end disposed on an upper end thereof, an outflow end mounted on a lower end thereof, and a passage located between the inflow and the outflow ends and having at least one cavity arranged on the outflow end;

at least one plug installed in the cavity of the holder and pushed downward and including a through bore to flow water;

a distributing set rotably installed to the outflow end of the holder and including an upper disc, a middle disc, and a lower cover, all of which are connected with each other; between the upper disc and the middle disc being defined an upper first chamber and an upper second chamber; between the middle disc and the lower cover being defined a lower first chamber at a central portion therebetween and a lower second chamber under the lower first chamber to communicate with the upper first chamber and the upper second chamber respectively; the upper disc including a first inlet and a second inlet disposed on a top surface thereof to communicate with the upper first chamber and the upper second chamber individually; the lower cover including at least two first outlets and a plurality of second outlets to communicate with the lower first chamber and the lower second chamber;

a low-flow controlling valve installed in the first inlet of the upper disc of the distributing set to lower water at a standard flow amount to a lower flow amount;

a water flower generator installed in the lower first chamber of the distributing set and including an inflow tunnel extending downward therefrom, at least two outflow tunnels extending from a peripheral side of the inflow tunnel, and al least two path extending along a tangent of the inflow tunnel and the outflow tunnel; the inflow tunnel including an entrance disposed on a top end thereof and communicating with the upper first chamber of the distributing set, and the outflow tunnel including a vent mounted on a bottom end thereof to communicate with an external environment through the first outlet of the distributing set; wherein after the water flow flows from the lower first chamber of the distributing set to the inflow tunnel of the water flower, a centrifugal force forms in the path and then passes through the outflow tunnel to spray water from the vents, obtaining low-flow and strong water flower;

a rotary positioning means fixed between the holder and the distributing set so that the distributing set is positioned between a first rotating position and a second rotating position;

when the distributing set is located at the first rotating position, water from the plug of the holder is controlled to become a low-flow water, and then flows through the upper first chamber and the water flower generator of the lower first chamber to generate a jetted water flower; when the distributing set is located at the second rotating position, water from the plug of the holder is controlled to become another water flower via the second inlet, the upper second chamber, and the lower second chamber.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
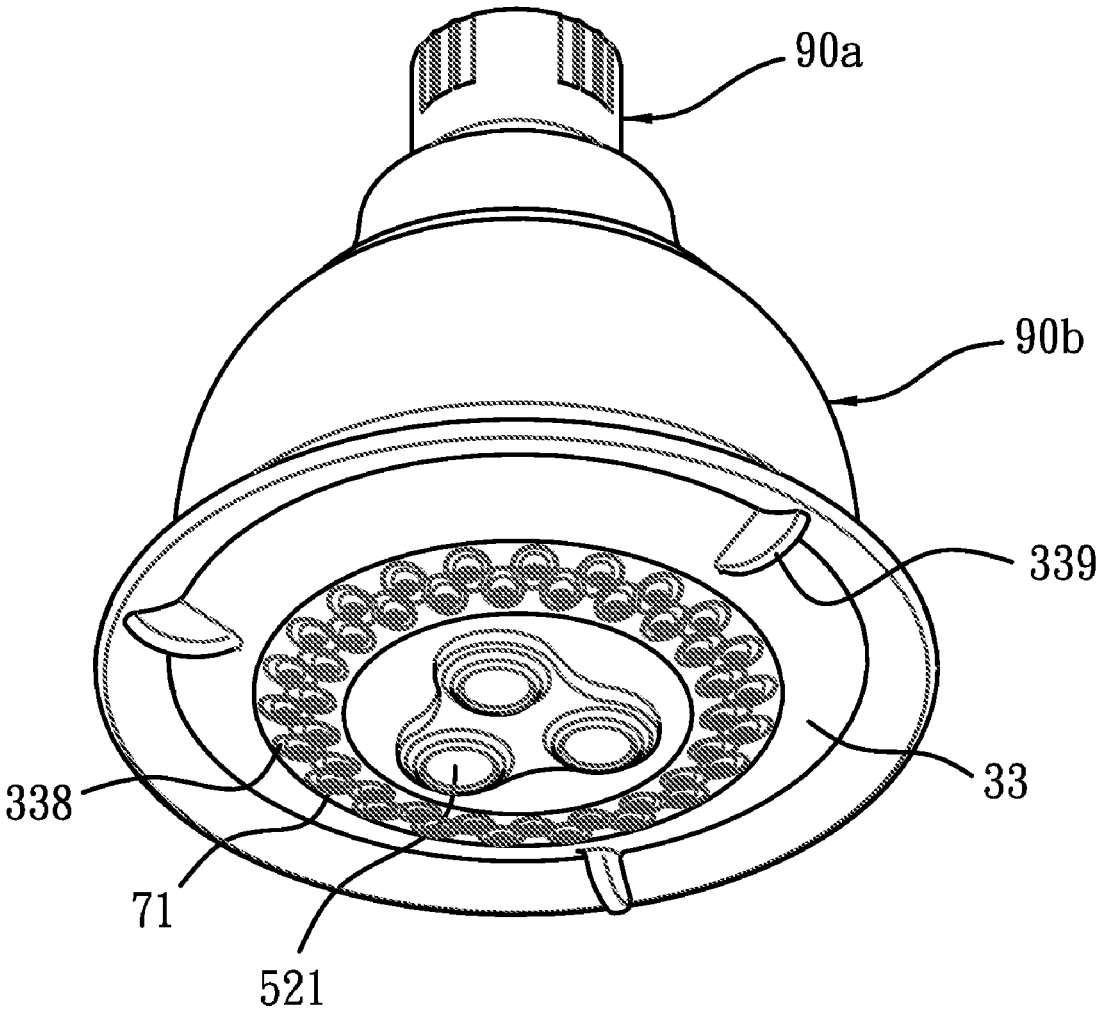
FIG. 1 is a perspective view showing the assembly of a multi-function shower head in accordance with a preferred embodiment of the present invention.

Referring to FIG. 1, a multi-function shower head in accordance with a preferred embodiment of the present invention is used in a wall type of shower head, wherein the shower head provides three water flower levels in response to three watering modes, such as a low-flow jetted water flower flowing from a central zone of the shower head, a low-flow massaged water flower flowing from a peripheral side of the jetted water flower, and a sprayed water flower watering from a peripheral side of the jetted water flower.

Figure 2:
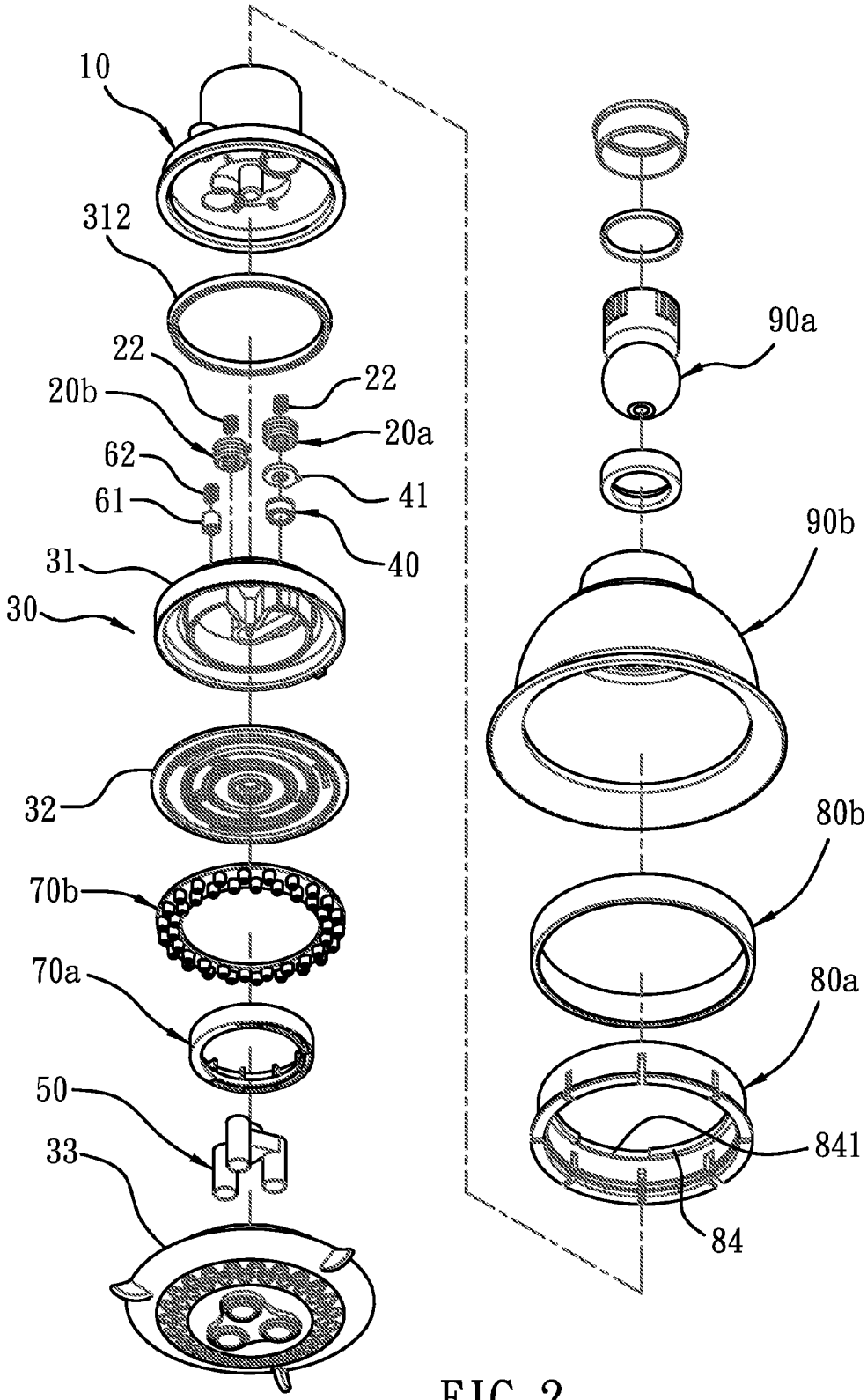
FIG. 2 is a perspective view showing the exploded components of the multi-function shower head in accordance with the preferred embodiment of the present invention.
Figure 3:
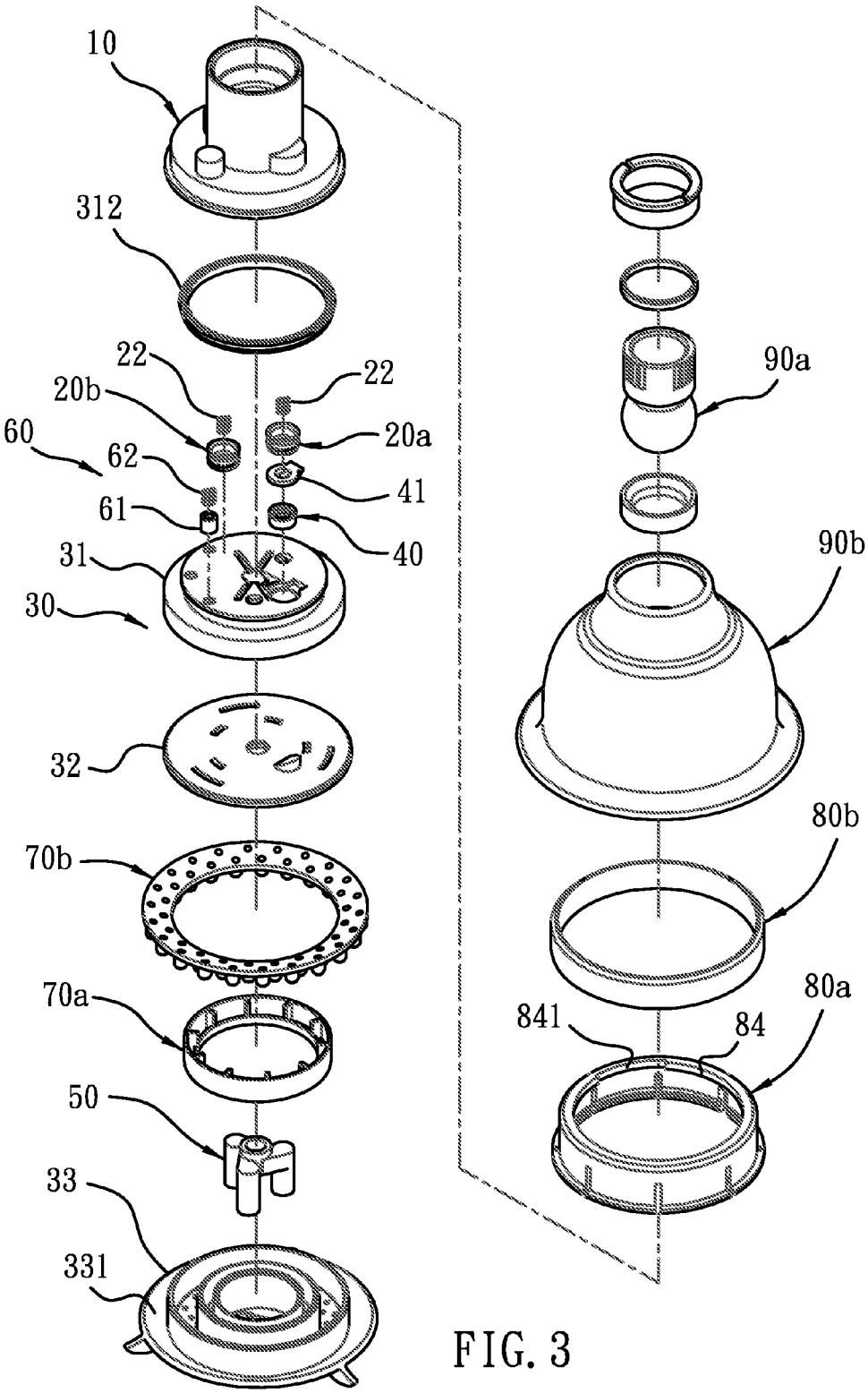
FIG. 3 is another perspective view showing the exploded components of the multi-function shower head in accordance with the preferred embodiment of the present invention.
Figure 4:
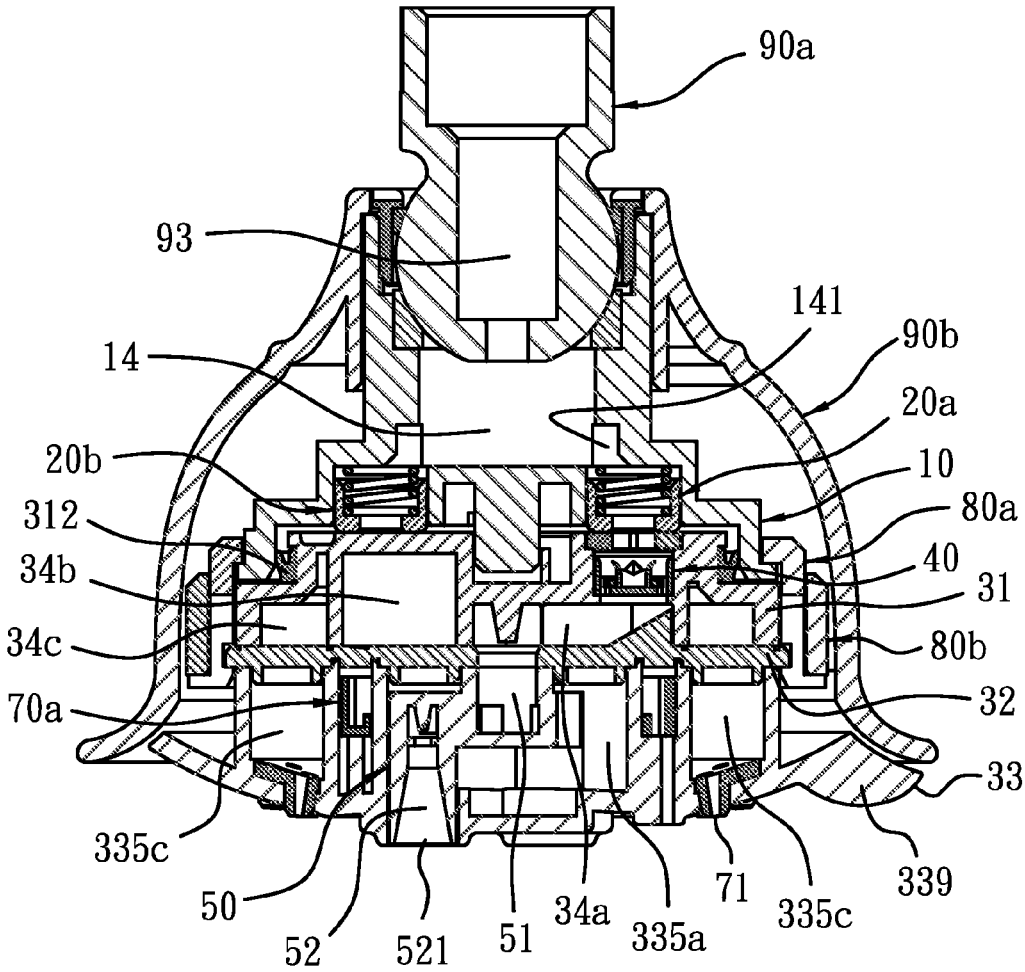
FIG. 4 is a cross sectional view showing the assembly of the multi-function shower head in accordance with the preferred embodiment of the present invention.
Figure 5:
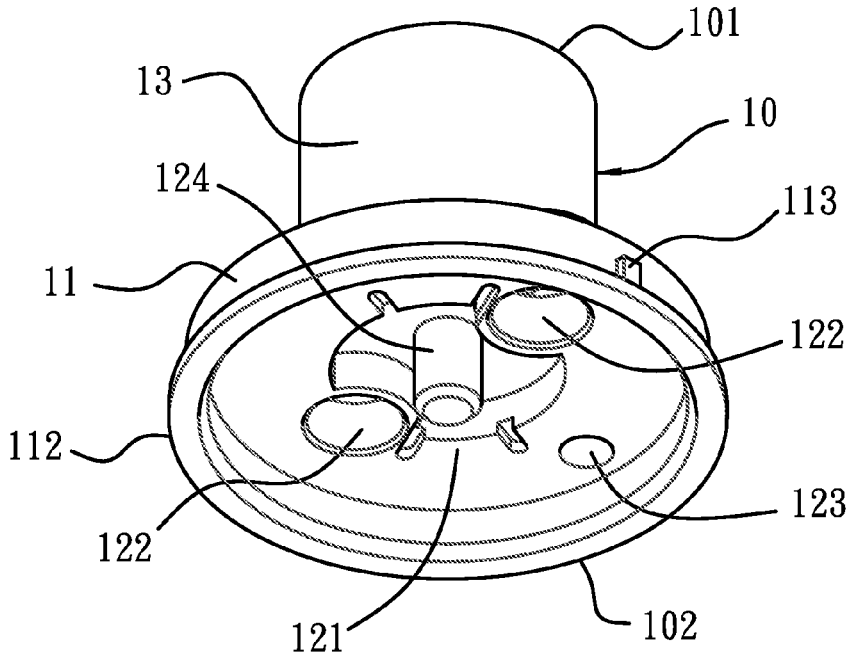
FIG. 5 is a perspective view showing the assembly of a holder of the multi-function shower head in accordance with the preferred embodiment of the present invention.
Figure 6:
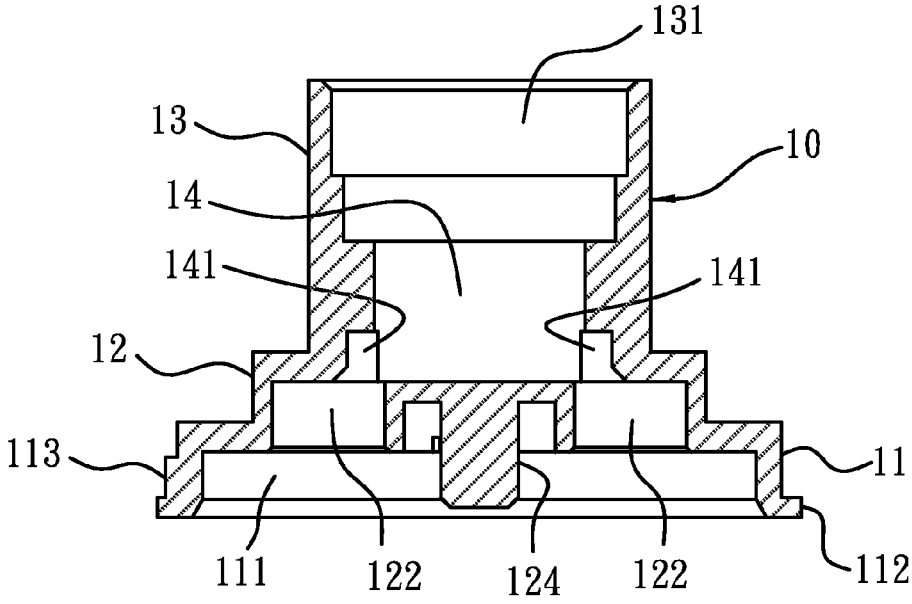
FIG. 6 is a cross sectional view showing the assembly of the holder of the multi-function shower head in accordance with the preferred embodiment of the present invention.

Referring to FIGS. 2-4, a multi-function shower head in accordance with a preferred embodiment of the present invention comprises a holder 10, two plugs 20*a*, 20*b*, a distributing set 30, a low-flow controlling valve 40, a water flower generator 50, a rotary positioning means 60, a rotating vane 70*a*, a spraying member 70*b*, a fixing member 80*a*, a retaining member 80*b*, a connecting knob 90*a*, and a housing 90*b*, wherein the holder 10, as shown in FIGS. 5 and 6, includes an inflow end 101 disposed on an upper end thereof and an outflow end 102 mounted on a lower end thereof, and includes a first outer rim 11, a second outer rim 12 extending upward from the first outer rim 11, and a third outer rim 13 extending from the second outer rim 12; the third outer rim 13 includes a receiving room 131 fixed on a top end of an interior thereof; the first outer rim 11 includes a circular groove 111 formed therein; the second outer rim 12 includes a spaced wall 121 arranged therein, and a bottom surface of the spaced wall 121 flushes with a top surface of the circular groove 111, the spaced wall 121 includes two symmetrical cavities 122 and a slot 123, all of which are mounted therein.

The holder 10 includes a passage 14 defined between the receiving room 131 and the spaced wall 121, and the passage 14 includes two guiding holes 141 fixed therein to communicate with the cavities 122 respectively. In addition, the spaced wall 121 includes a recessed portion formed at a center thereof and a shaft 124 extending downward from the recessed portion thereof.

The first outer rim 11 includes a limiting tab 112 extending outward from a bottom end thereof and an engaging projection 113 extending from an external side thereof to connect with the limiting tab 112.

Figure 7:
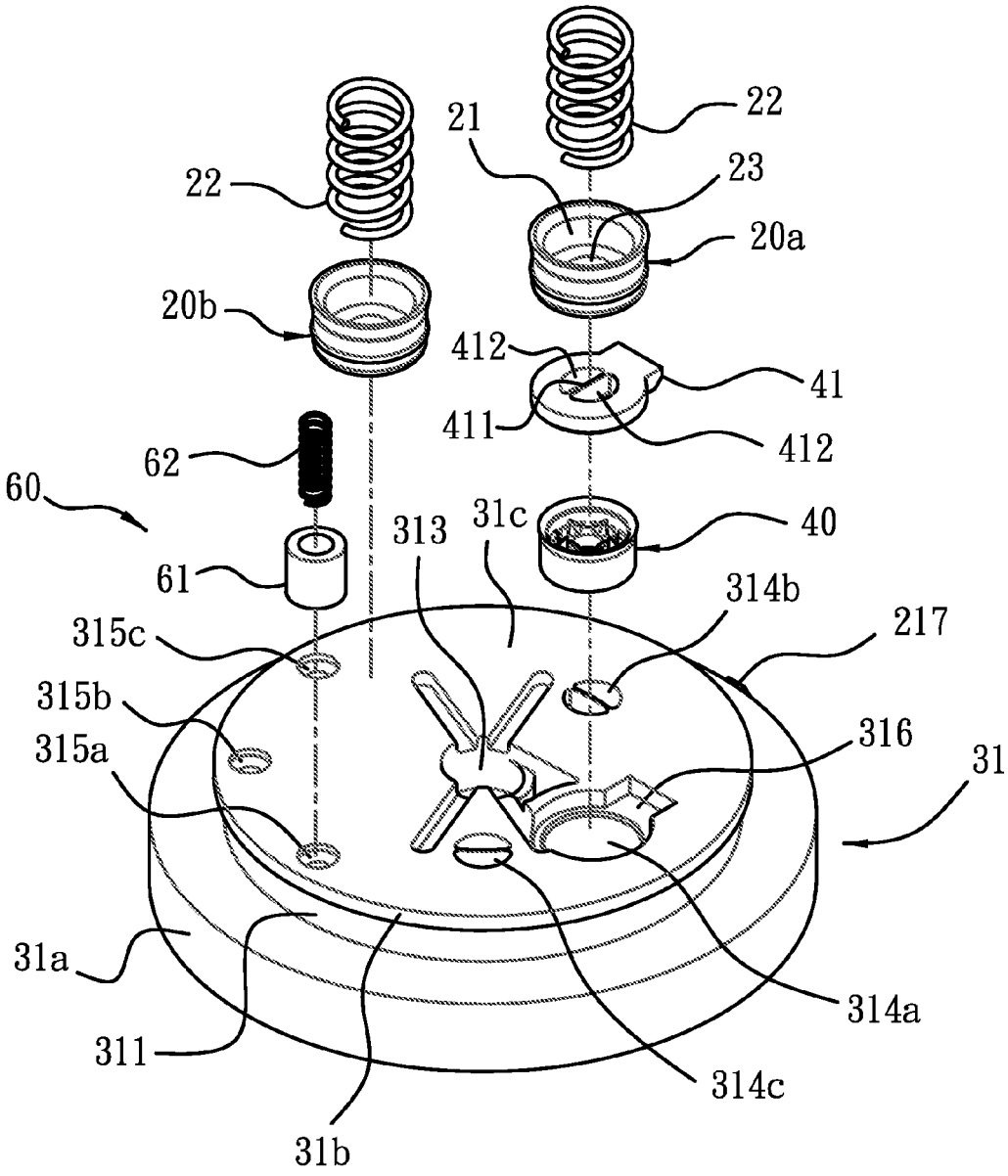
FIG. 7 is a perspective view showing the exploded components of an upper disc of the multi-function shower head in accordance with the preferred embodiment of the present invention.

The plugs 20*a*, 20*b*, as illustrated in FIG. 7, are installed in the cavities 122 of the holder 10, and each includes a notch 21 formed at a top end thereof to receive a compression spring 22 so as to push the plugs 20*a*, 20*b* and includes a through bore 23 disposed on a bottom end thereof to communicate with the notch 21, thus flowing water from the guiding holes 141.

Figure 8:
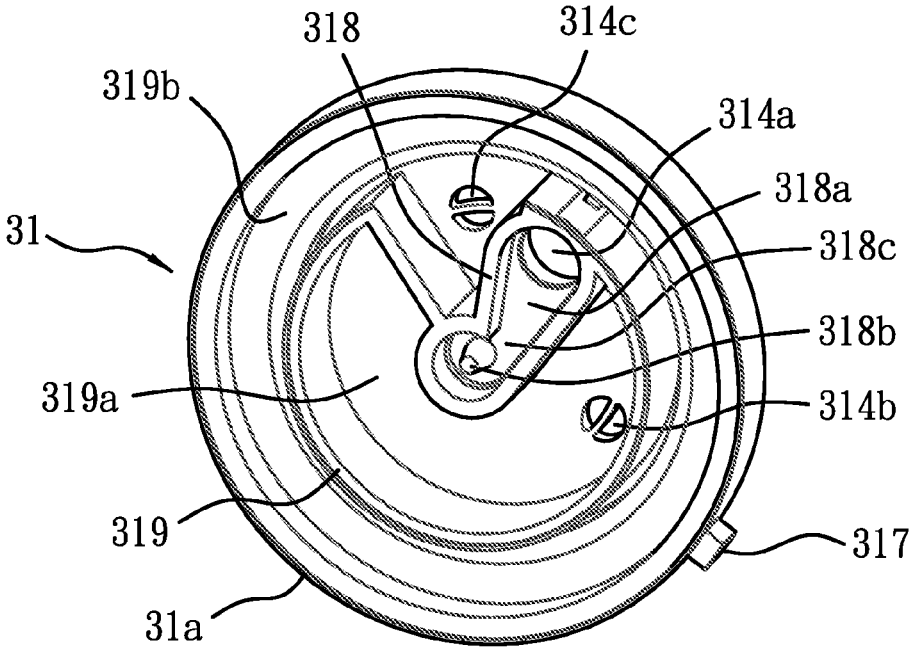
FIG. 8 is a perspective view showing the assembly of the upper disc of the multi-function shower head in accordance with the preferred embodiment of the present invention.
Figure 9:
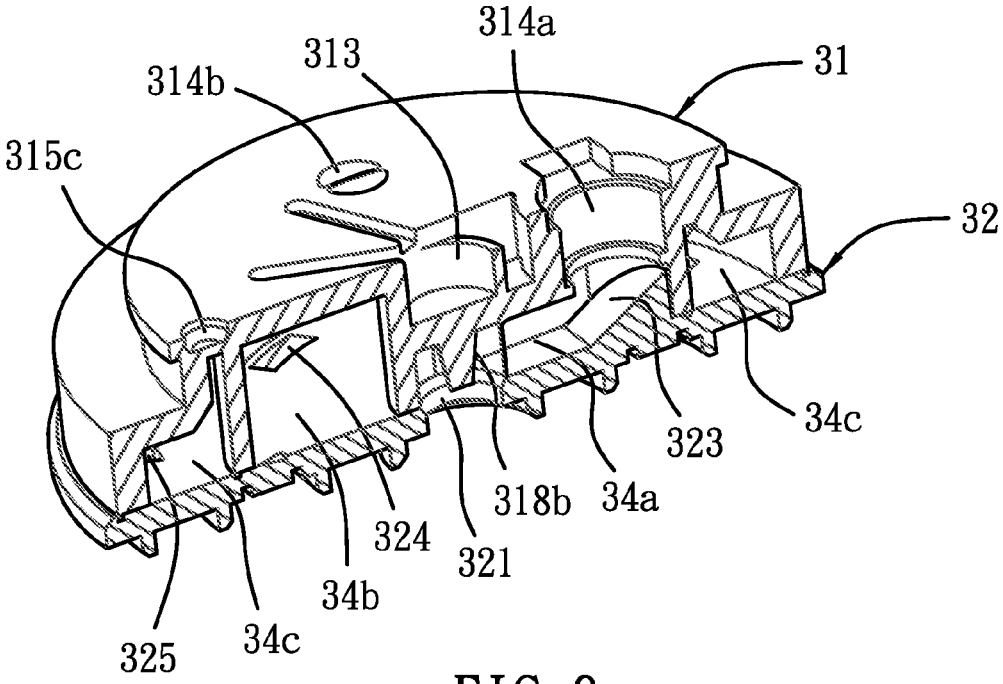
FIG. 9 is a partial perspective view showing the cross section of the upper disc and a middle disc of the multi-function shower head in accordance with the preferred embodiment of the present invention.

The distributing set 30 is rotably installed to the outflow end 102 of the holder 10 and includes an upper disc 31, a middle disc 32, and a lower cover 33, wherein the upper disc 31 as shown in FIGS. 7-9 includes a lower fringe 31*a*, an upper fringe 31*b* extending upward from the lower fringe 31*a*, and a top surface 31*c* formed on the upper fringe 31*b*; the upper fringe 31*b* includes a locking recess 311 to retain a seal pad 312 as illustrated in FIGS. 2-4. The top surface 31*c* includes an axial opening 313 mounted at a center thereof to connect with the shaft 124 of the holder 10 so as to form a rotating fulcrum between the upper disc 31 and the holder 10; the axial opening 313 includes a plurality of inlets spaced a predetermined angle apart from each other, and the inlets are a first inlet 314*a*, a second inlet 314*b*, and a third inlet 314*c* to communicate with one of the plugs 20*a*, 20*b*; the axial opening 313 includes a number of fixing apertures spaced a predetermined angle apart from each other, and the fixing apertures are a first fixing aperture 315*a*, a second fixing aperture 315*b*, and a third fixing aperture 315*c*.

The upper disc 31 includes a positioning gap 316 disposed around a top end of the first inlet 314*a*, and the lower fringe 31*a* includes a lock protrusion 317 extending outward thereform.

The top surface 31*c* of the upper disc 31 includes a first face 318 and a second face 319 between which a connecting section is defined, the first face 318 includes a first recessed zone 318*a*, and the second face 319 includes a second recessed zone 319*a*, and between the first face 318, the second face 319, and the lower fringe 31*a* is define a third recessed zone 319*b*.

The first recessed zone 318*a* extends from an outer side of the upper disc 31 toward a central portion thereof, and the first inlet 314*a* is in communication with the first recessed zone 318*a*, the first recessed zone 318*a* includes a conical column 318*b* extending from a central portion thereof and a conical mouth 318*c* facing to the conical column 318*b* so that water from the first inlet 314*a* flows through the conical mouth 318*c* and is guided to one side of the conical column 318*b*, generating a spiral water flow. The second inlet 314*b* is communication with the second recessed zone 319*a*, and the third inlet 314*c* communicates with the third trench 319*b*.

The upper disc 31 rotates relative to the holder 10, and when it is rotated to a first rotating position, the plug 20*a* communicates with the first inlet 314*a* to guide water from the plug 20*a* toward the first recessed zone 318*a* via the first inlet 314*a*, and the plug 20*b* is closed by the top surface 31*c* of the upper disc 31. Likewise, as the upper disc 31 is rotated to a second rotating position of the holder 10, the plug 20*a* communicates with the second inlet 314*b* and the plug 20*b* is closed by the top surface 31*c* of the upper disc 31, and when the upper disc 31 is rotated to a third rotating position of the holder 10, the plug 20*b* is communication with the third inlet 314*c* and the plug 20*a* is closed by the top surface 31*c* of the upper disc 31.

The seal pad 312 of the upper disc 31 abuts against an inner side of the first outer rim 11 to prevent waters which leaks from the plugs 20*a*, 20*b* from flowing outward from the holder 10 and the upper disc 31.

Figure 10:
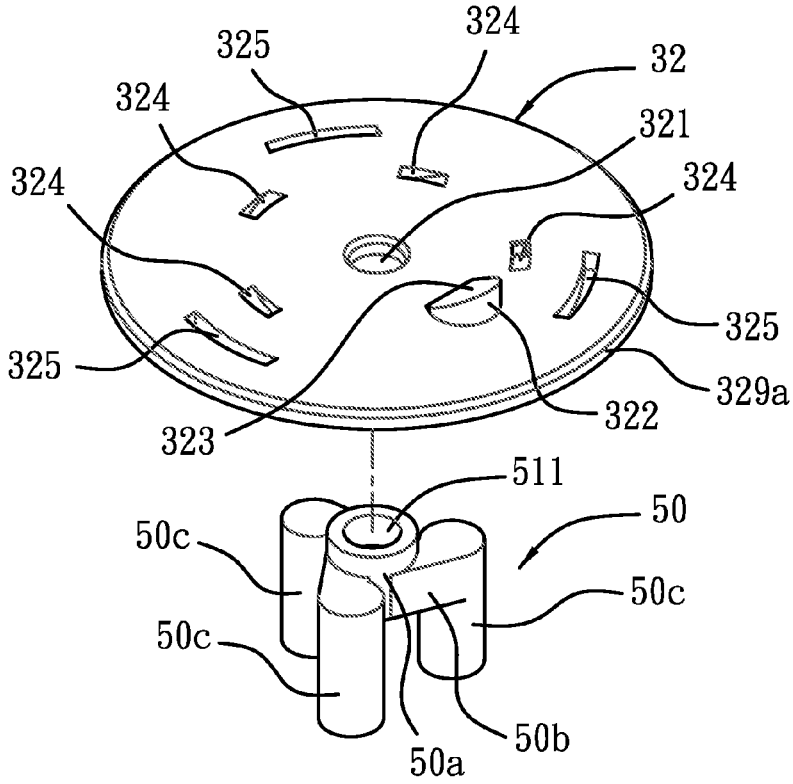
FIG. 10 is a perspective view showing the exploded components of the middle disc and a water flower generator of the multi-function shower head in accordance with the preferred embodiment of the present invention.
Figure 11:
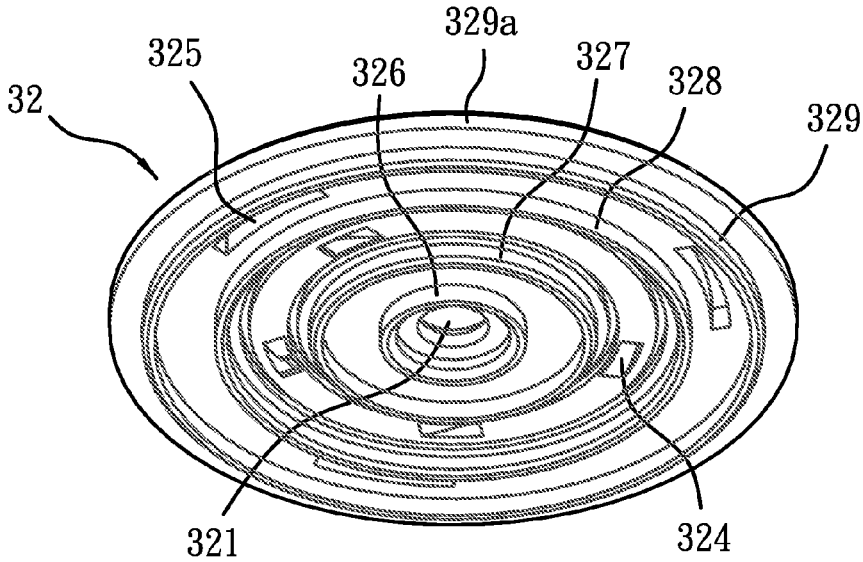
FIG. 11 is a perspective view showing the assembly of the middle disc of the multi-function shower head in accordance with the preferred embodiment of the present invention.
Figure 12:
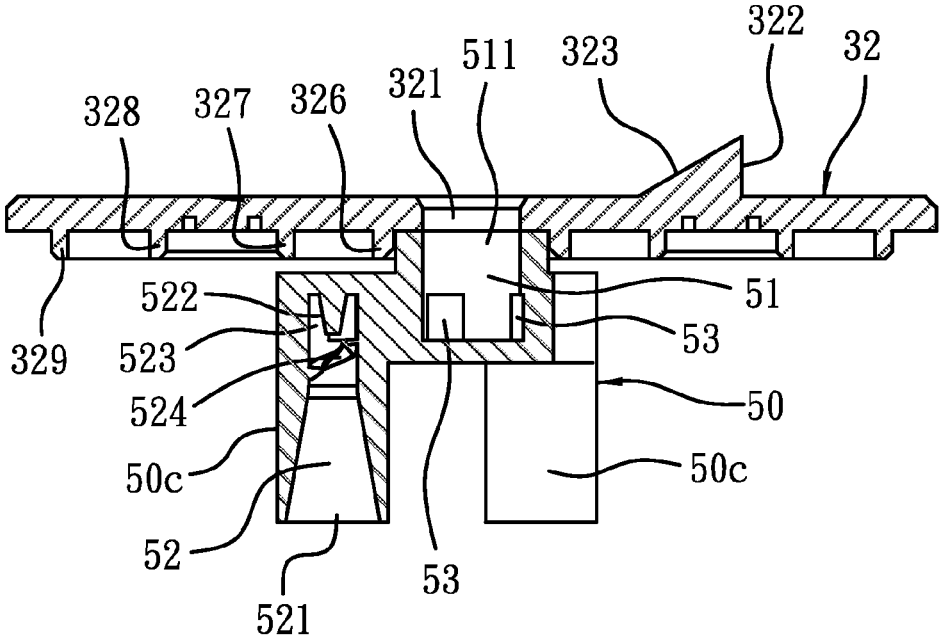
FIG. 12 is a cross sectional view showing the assembly of the middle disc and the water flower generator of the multi-function shower head in accordance with the preferred embodiment of the present invention.
Figure 13:
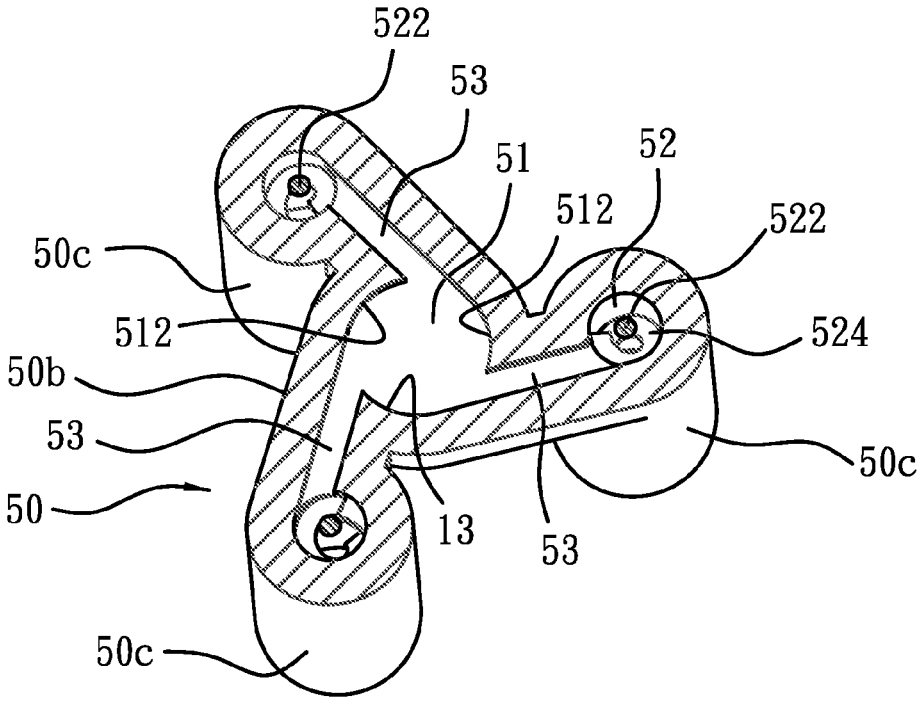
FIG. 13 is a partial perspective view showing the cross section of the water flower generator of the multi-function shower head in accordance with the preferred embodiment of the present invention.
Figure 14:
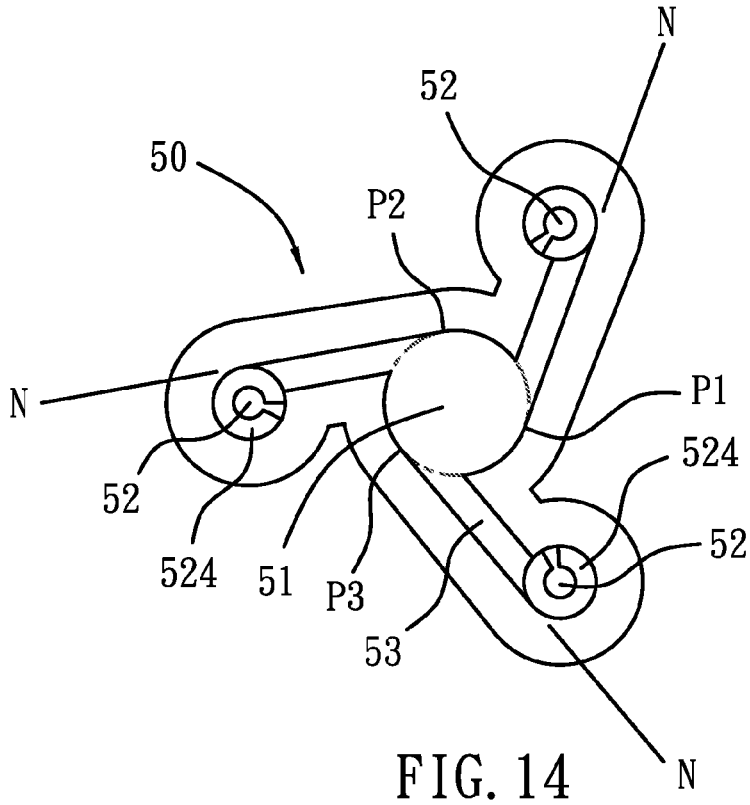
FIG. 14 is a top plan view showing the assembly of the water flower generator of the multi-function shower head in accordance with the preferred embodiment of the present invention.

The middle disc 32, as shown in FIGS. 10-12, is formed in a flat disk shape and welded with the lower fringe 31*a* of the upper disc 31 so that between the middle disc 32, the first, second, and third recessed zones 318*a*, 319*a*, and 319*b* of the upper disc 31 are defined an upper first chamber 34*a*, an upper second chamber 34*b*, and an upper third chamber 34*c*.

The middle disc 32 includes a first orifice 321 arranged at a center thereof to communicate with the upper first chamber 34*a* so that a spiral water flow in the conical column 318*b* of the upper first chamber 34*a* flows to the first orifice 321. The first orifice 321 includes a raised block 322 extends therefrom to engage with the first recessed zone 318*a* of the upper disc 31 and having an inclined plane 323 disposed on a top end of the raised block 322 so as to guide a longitudinal water flow from the first inlet 314*a* to the conical column 318*b* to generate a lateral water flow.

The first orifice 321 of the middle disc 32 includes four second orifices 324 spaced a predetermined angle apart from each other to communicate with the upper second chamber 34*b*, and the second orifice 324 includes three third orifices 325 spaced a predetermined angle apart from each other to communicate with the upper third chamber 34*c*.

The middle disc 32 includes a first, a second, a third, and a fourth annular sides 326, 327, 328, and 329 extending longitudinally from an outer rim of the first orifice 321 in order, and includes a retaining edge 329*a* arranged around the middle disc 32.

Figure 17:
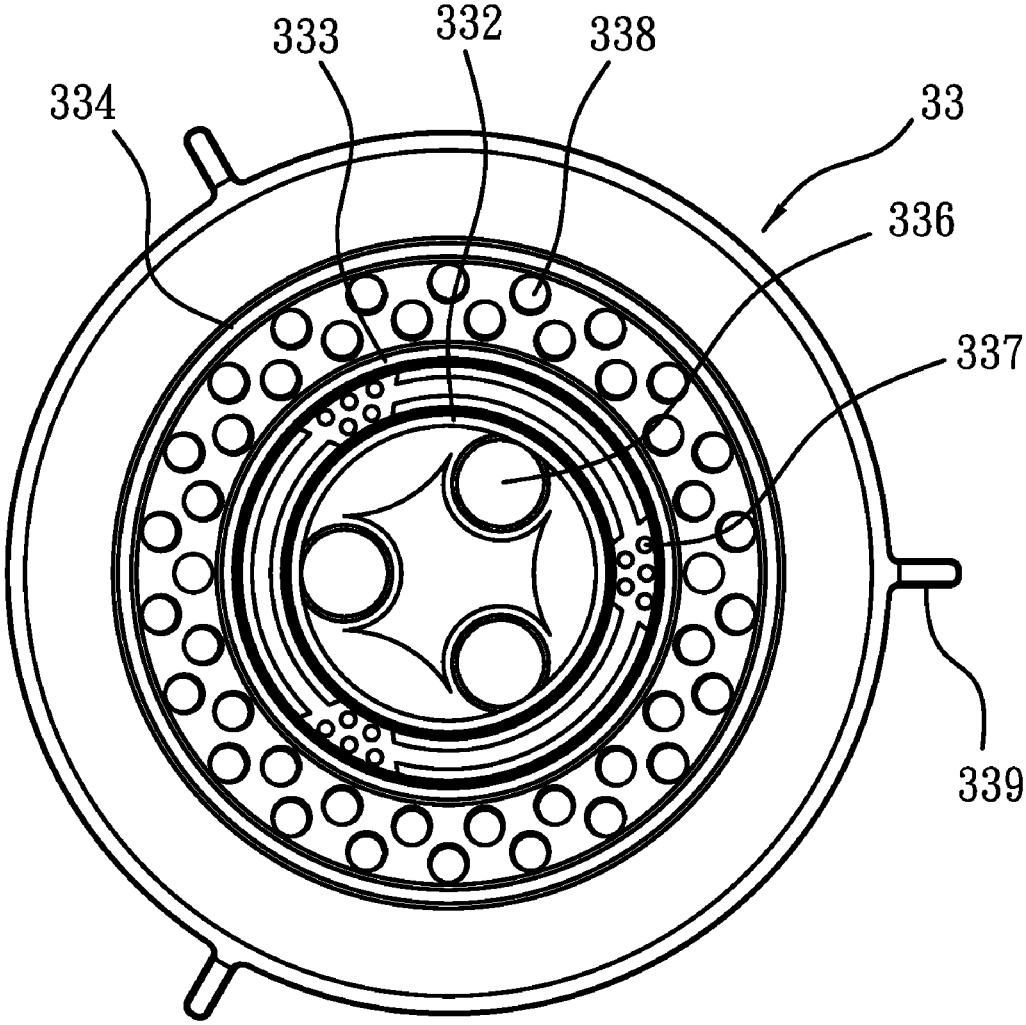
FIG. 17 is a top plan view showing the assembly of a lower cover of the multi-function shower head in accordance with the preferred embodiment of the present invention.

The lower cover 33, as illustrated in FIGS. 3, 17, includes a side portion 331 having a first, a second, and a third sealing cliffs 332, 333, 334 extending longitudinally in order to be fitted and welded with the first, the second, and the third annular sides 326, 327, and 328 of the middle disc 32 such that between the middle disc 32 and the first sealing cliff 332 of the lower cover 33 is defined a lower first chamber 335*a*, between the first and the second sealing cliffs 332, 333 is defined a lower second chamber 335*b*, and between the second and the third sealing cliffs 333, 334 is defined a lower third chamber 335*c*.

The side portion 331 of the lower cover 33 includes three first outlets 336 to abut against the first sealing cliff 332, and between the first and the second sealing cliffs 332, 333 are defined three sets of watering areas, each having a plurality of second outlets 337, and between the second and the third sealing cliffs 333, 334 are arranged a number of three outlets 338. A size of the first outlet 336 is more than that of the third outlets 338, and a size of the third outlet 338 is more than that of the second outlet 337. It is to be noted that the second outlet 337 is a tiny hole substantially.

The lower cover 33 includes three levering extensions 339 extending outward therefrom to be operated by user to stop a rotation of the distributing set 30 and the holder 10 relative to each other.

The low-flow controlling valve 40, as shown in FIG. 7, is fixed in the first inlet 314*a* of the upper disc 31 of the distributing set 30 to lower water flow.

In order to flow water from the plug 20*a* toward the low-flow controlling valve 40, an abutting plate 41 is disposed to the positioning gap 316 of the first inlet 314*a* of the upper disc 31 and includes a partition 411 arranged on a middle portion thereof to separate two intakes 412 apart, such that a bottom end of the abutting plate 41 connects with a top end of the low-flow controlling valve 40 and a top surface thereof is biased against the through bore 23 stably.

The water flower generator 50, as illustrated in FIGS. 10 and 12-14, includes a top pillar 50*a*, three coupling portions 50*b* extending from the top pillar 50*a*, and three bottom pillars 50*c* extending from the coupling portions 50*b* so that the water flower generator 50 is received in the lower first chamber 335*a* of the distributing set 30, and the top pillar 50*a* is engaged and welded with the first face 318 of the middle disc 32, the bottom pillars 50*c* are inserted in the first outlets 336 of the lower cover 33.

The top pillar 50*a* of the water flower generator 50 includes an inflow tunnel 51 formed therein and having an entrance 511 arranged on a top end of the inflow tunnel 51, and the bottom pillar 50*c* includes an outflow tunnel 52 formed therein and having a vent 521 fixed on a bottom end of the outflow tunnel 52; the coupling portion 52*b* includes a path 53 disposed therein, two ends of the path 53 communicate with a bottom end of the inflow tunnel 51 and a top end of the outflow tunnel 52, and a width of the path 53 is less than those of the inflow tunnel 51 and the outflow tunnel 52 and communicates eccentrically with the inflow tunnel 51 and the outflow tunnel 52. Substantially, the path 53 extends along a tangent of the inflow tunnel 51 and the outflow tunnel 52 in the N direction, and the inflow tunnel 51 includes three arcuate margins 512 mounted on a bottom end thereof and connecting with one sides of the paths 53 at tangent points p1-p3 of the paths 53, such that as spiral water flow passes through the first orifice 321 of the distributing set 30 and the water flower generator 50 toward the inflow tunnel 51, the spiral water flower enters to the paths 53 so as to strengthen water flow. Also, the paths 53 extend at tangent points of the outflow tunnel 52 so that the waters in the paths 53 generate a spiral water flow after flowing into the top end of the outflow tunnel 52.

The outflow tunnel 52 includes a cone-shaped member 522 extending downward from a top side thereof so that water in the outflow tunnel 52 is further guided to one side of the cone-shaped member 522 to generate a spiral water flow stably.

The outflow tunnel 52 further includes a spiral impeller 524 disposed thereon relative to the path 53 to form a spiral water flow, and one side of the outflow tunnel 52 under the spiral impeller 524 is enlarged so that the spiral water flow sprays from the outflow tunnel 52 to generate an increased water flower to enhance spraying area. For example, circular water-flower areas spraying from the three vents 521 overlap with each other to obtain a common spraying area, wherein a spraying area keeping away 4 ft from the vent 521 generates a 65 cm of area more than a 31 cm of area of the shower head.

The path 53 extends along a tangent of the inflow tunnel 51 in N direction to enter spiral water flow to the path 53, and a rotating direction of the tangent is identical to a spiral direction of the spiral water flow in the inflow tunnel 51 without being limited in a specific direction.

The rotary positioning means 60, as shown in FIG. 7, includes a levering pin 61 disposed in the slot 123 of the holder 10, a compression spring 62, and the first, the second, and the third fixing apertures 315*a*, 315*b*, 315*c* of the upper disc 31, wherein the compression spring 62 is received in a space 611 of the levering pin 61 so as to push the levering pin 61 downward to retain in one of the first, the second, and the third fixing apertures 315*a*, 315*b*, 315*c*. For example, as the distributing set 30 is operated to rotate relative to the holder 10, the levering pin 61 engages with the first fixing aperture

315*a*, and the distributing set 30 is located at the first rotating position, the plug 20*a* is in relation to the first inlet 314; and when the levering pin 61 engages with the second fixing aperture 315*b*, the distributing set 30 is located at the second rotating position, and the plug 20*a* is in relation to the second inlet 314*b*; when the levering pin 61 engages with the third fixing aperture 315*c*, the distributing set 30 is located at the third rotating position, and the plug 20*b* is in relation to the third inlet 314*c*.

Figure 15:
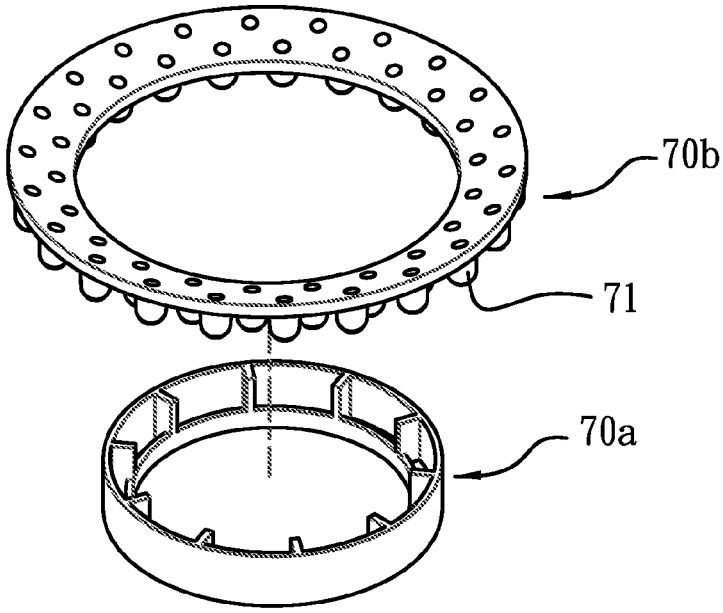
FIG. 15 is a perspective showing the exploded components of a vane and a spraying member of the multi-function shower head in accordance with the preferred embodiment of the present invention.
Figure 16:
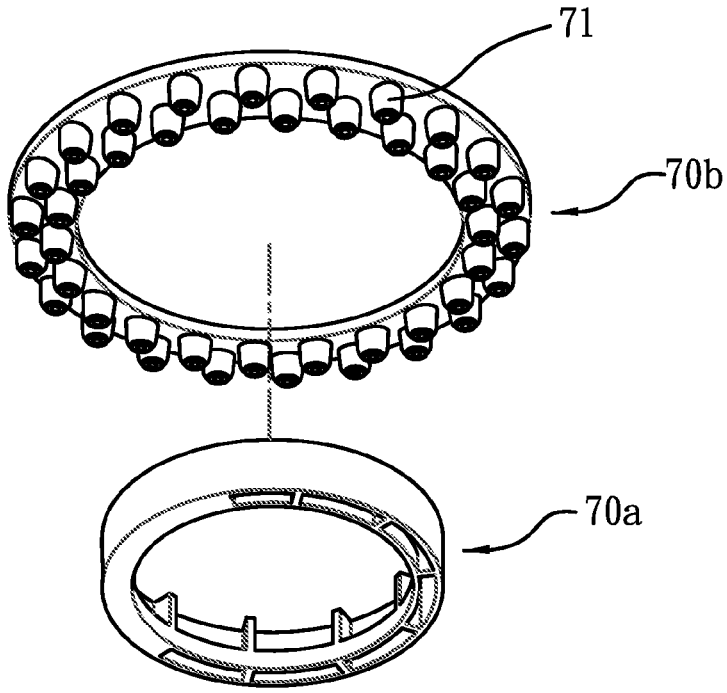
FIG. 16 is another perspective showing the exploded components of the vane and the spraying member of the multi-function shower head in accordance with the preferred embodiment of the present invention.

The rotating vane 70*a*, as illustrated in FIGS. 15, 16, is installed to the lower second chamber 335*b* of the distributing set 30 and impacted by water in the lower second chamber 335*b* to rotate automatically in an annular space of the lower second chamber 335*b* so that the second outlets 337 of the lower cover 33 are stopped by the rotating vane 70*a* to generate an intermittent water flow, obtaining massaged water flower. Because the vane is well known, further remarks are omitted.

The spraying member 70*b*, as shown in FIGS. 15 and 16, is installed in the lower third chamber 335*c* of the distributing set 30, and includes a plurality of nozzles 71 to be inserted in the third outlets 338 so that water in the lower third chamber 335*c* are sprayed to form water flower after flowing through the nozzles 71 of the spraying member 70*b*.

Figure 18:
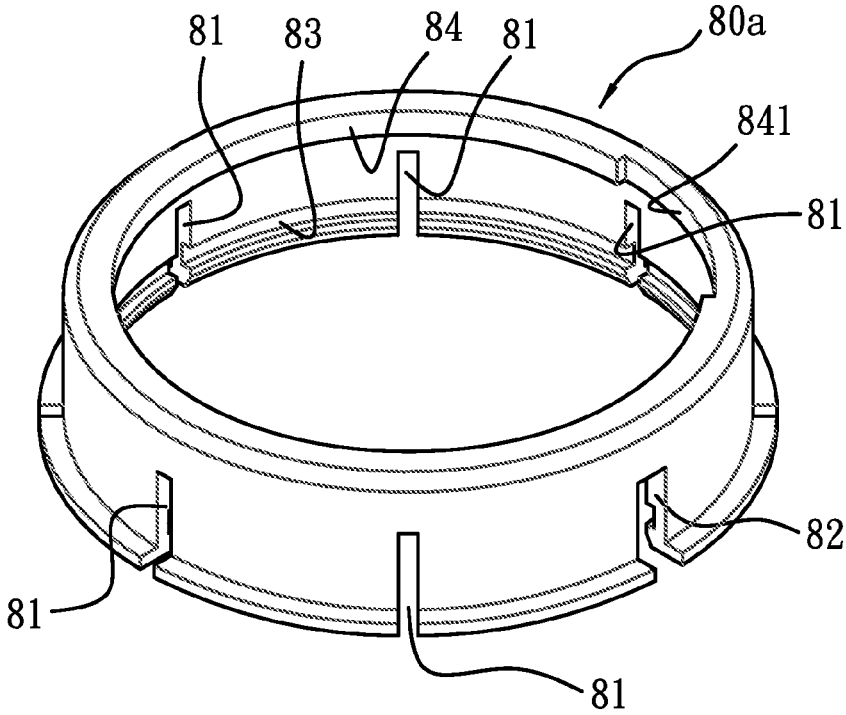
FIG. 18 is a perspective view showing the assembly of a fixing member of the multi-function shower head in accordance with the preferred embodiment of the present invention.

The fixing member 80*a*, as illustrated in FIG. 18, includes a plurality of longitudinal cutouts 81 and a longitudinal indentation 82, the cutout 81 is used to expand a lower end of the fixing member 80*a* flexibly to install related components easily.

The fixing member 80*a* includes an annular dent 83 mounted around a lower end thereof so that when the upper disc 31 is fitted to the fixing member 80*a*, the lock protrusion 317 is retained to the longitudinal indentation 82, such that the upper disc 31 is limited to rotate with the distributing set 30, and the retaining edge 329*a* of the middle disc 32 is retained to the dent 83 to connect with the fixing member 80*a* securely.

The fixing member 80*a* further includes a defining lip 84 fixed around a top end thereof and having a cut 841 on the defining lip 84. When the holder 10 is fitted to the fixing member 80*a*, the limiting tab 112 is engaged by the defining lip 84 of the fixing member 80*a* so that the holder 10 rotates relative to the fixing member 80*a* and the distributing set 30 by using the defining lip 84 and the limiting tab 112. It is to be noted that as assembling the holder 10, the engaging projection 113 is aligned to the cut 841 of the fixing member 80*a* so that the holder 10 and the fixing member 80*a* are limited to rotate in a specific range by the cut 841, wherein the specific rotating range is between the first, the second, and the third fixing apertures 315*a*, 315*b*, 315*c* of the upper disc 31, hence the levering pin 61 allows to move and position between the first, the second, and the third fixing apertures 315*a*, 315*b*, 315*c*.

The retaining member 80*b*, as shown in FIGS. 2-4, is fitted to a peripheral side of the fixing member 80*a* to assemble the fixing member 80*a* and the distributing set 30 securely.

The connecting knob 90*a*, as illustrated in FIGS. 2-4, includes an entering end 91 to be connected with a water feeding pipe, a spherical exiting end 92, and an internal passageway 93 communicating with the entering and the exiting ends 91, 92, and the exiting end 92 couples with the inflow end 101 of the holder 10. In the internal passageway 93 of the connecting knob 90*a* is installed a standard flow controlling valve to control the water flow at 2.5 GPM/min. Because the standard flow controlling valve is well known, further remark is omitted.

The housing 90*b*, as shown in FIGS. 1-4, is fitted to the inflow end 101 of the holder 10 to cover the holder 10 and the distributing set 30.

With reference to FIGS. 1-4, in operation of the multi-function shower head, the levering extension 339 of the lower cover 33 is rotated to control the rotation of the distributing set 30 and the holder 10 relative to each other, and the levering pin 61 of the holder 10 is inserted to one of the first, the second, and the third fixing apertures 315*a*, 315*b*, 315*c*. As shown in FIG. 7, one of the plugs 20*a*, 20*b* is in communication with one of the first, the second, and the third inlets 314*a*, 314*b*, 314*c* to flow water to correspond the chamber and the outlet so as to generate water flower in correspondingly watering mode to satisfy different demands.

Figure 19:
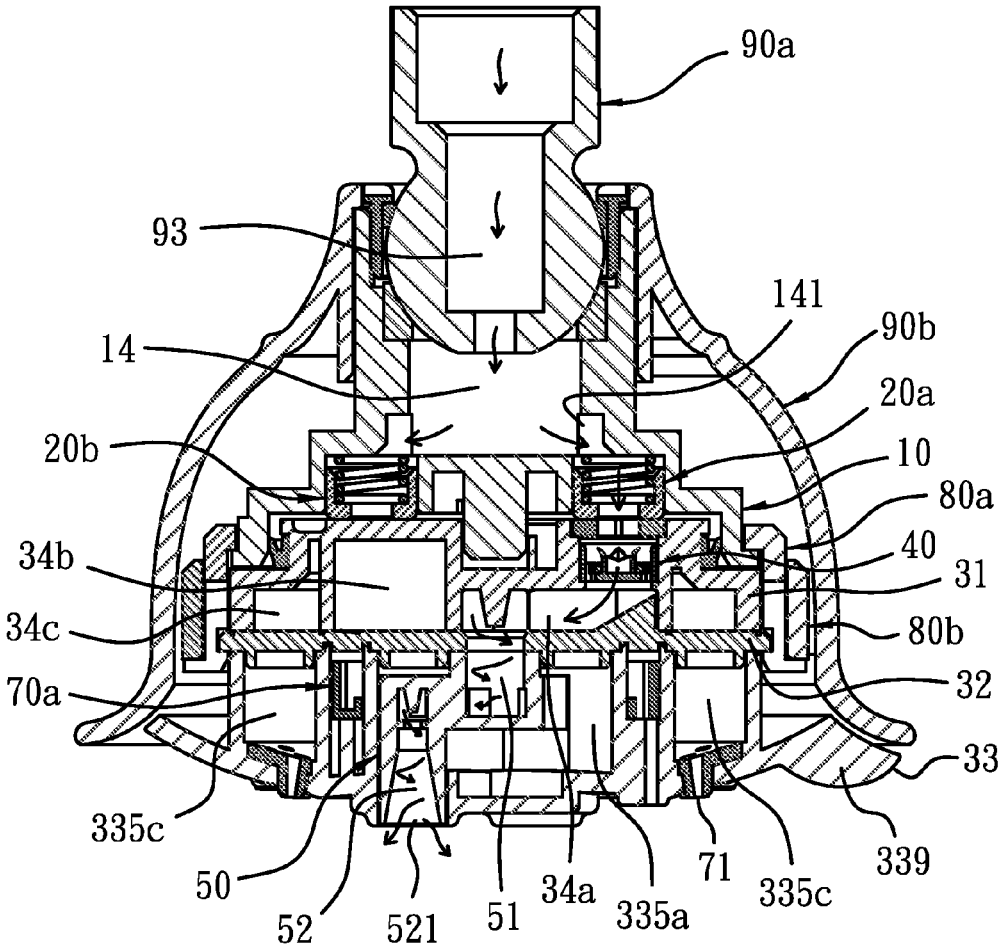
FIG. 19 is a cross sectional view showing the operation of the multi-function shower head in accordance with the preferred embodiment of the present invention.

The multi-function shower head has the following advantages:

In operation, when the distributing set 30 is rotated to a high-flow watering mode (e.g., the first rotating position) as shown in FIG. 19, the levering pin 61 is inserted to the first fixing aperture 315*a* so that the plug 20*a* communicates with the first inlet 314*a*, such that after the original water flow passes through the low-flow controlling valve 40 of the first inlet 314*a*, it becomes a low water flow, and then the water further flows through the inclined plane 323, the first face 318, and the conical column 318*b* to generate spiral water flow to flow into the water flower generator 50. Thereafter, the water flow passes through the path 53 from the inflow tunnel 51 to result in a centrifugal force, and then passes through the cone-shaped member 522 of the outflow tunnel 52, the spiral impeller 524, and an increased flowing path to spray water from the vents 521, obtaining low-flow and strong water flower. Thereby, a water saving and strong flowing purpose of the shower head is achieved.

While we have shown and described various embodiments in accordance with the present invention, it is clear to those skilled in the art that further embodiments may be made without departing from the scope of the present invention.

What is claimed is:

1. A multi-function shower head comprising a holder including an inflow end disposed on an upper end thereof, an outflow end mounted on a lower end thereof, and a passage located between the inflow and the outflow ends and having at least one cavity arranged on the outflow end;

at least one plug installed in the cavity of the holder and pushed downward and including a through bore to flow water;

a distributing set rotably installed to the outflow end of the holder and including an upper disc, a middle disc, and a lower cover, all of which are connected with each other; between the upper disc and the middle disc being defined an upper first chamber and an upper second chamber; between the middle disc and the lower cover being defined a lower first chamber at a central portion therebetween and a lower second chamber under the lower first chamber to communicate with the upper first chamber and the upper second chamber respectively; the upper disc including a first inlet and a second inlet disposed on a top surface thereof to communicate with the upper first chamber and the upper second chamber individually; the lower cover including at least two first outlets and a plurality of second outlets to communicate with the lower first chamber and the lower second chamber;

a low-flow controlling valve installed in the first inlet of the upper disc of the distributing set to lower water at a standard flow amount to a lower flow amount;

a water flower generator installed in the lower first chamber of the distributing set and including an inflow tunnel extending downward therefrom, at least two outflow tunnels extending from a peripheral side of the inflow tunnel, and al least two path extending along a tangent of the inflow tunnel and the outflow tunnel; the inflow tunnel including an entrance disposed on a top end thereof and communicating with the upper first chamber of the distributing set, and the outflow tunnel including a vent mounted on a bottom end thereof to communicate with an external environment through the first outlet of the distributing set; wherein after the water flow flows from the lower first chamber of the distributing set to the inflow tunnel of the water flower, a centrifugal force forms in the path and then passes through the outflow tunnel to spray water from the vents, obtaining low-flow and strong water flower;

a rotary positioning means fixed between the holder and the distributing set so that the distributing set is positioned between a first rotating position and a second rotating position;

when the distributing set is located at the first rotating position, water from the plug of the holder is controlled to become a low-flow water, and then flows through the upper first chamber and the water flower generator of the lower first chamber to generate a jetted water flower; when the distributing set is located at the second rotating position, water from the plug of the holder is controlled to become another water flower via the second inlet, the upper second chamber, and the lower second chamber.

2. The multi-function shower head as claimed in claim 1, wherein the first inlet is disposed around of the upper disc; the middle disc includes a first orifice arranged at a central portion thereof to communicate with the upper first chamber and the lower first chamber; the upper first chamber includes a conical mouth formed from the first inlet to the first orifice, and the upper first chamber includes a cone-shaped member extending downward from a top side thereof in relation to the first orifice.

3. The multi-function shower head as claimed in claim 2, wherein the middle disc includes an inclined plane disposed on a top surface thereof in relation to the first inlet of the upper disc so as to guide a longitudinal water flow from the first inlet to the conical column, generating a lateral water flow.

4. The multi-function shower head as claimed in claim 1, wherein the path laterally extends along a rotating tangent direction of the top end of a relative inflow tunnel, and the outflow tunnel includes a cone-shaped member extending downward form a top end thereof, so that a horizontal water flows from the path is guided to one side of the cone-shaped member and then is further guided by the cone-shaped member and an annular space around the cone-shaped member to generate a spiral water flow.

5. The multi-function shower head as claimed in claim 4, wherein the outflow tunnel includes a spiral impeller disposed thereon relative to the path to form a spiral water flow, and one side of the outflow tunnel under the spiral impeller is enlarged.

6. The multi-function shower head as claimed in claim 1, wherein the water flower generator includes three paths and three outflow tunnels spaced a predetermined angle apart from each other; the lower cover includes three first outlets relative to each other.

7. The multi-function shower head as claimed in claim 2, wherein the water flower generator includes a top pillar relative to the top end of the inflow tunnel; the middle disc includes a first annular side extending longitudinally from an outer rim of the first orifice to retain the top pillar; the water flower generator includes a bottom pillars extending from a bottom end thereof relative to the outflow tunnel so as to be inserted in the first outlets of the lower cover.

8. The multi-function shower head as claimed in claim 1, wherein between the upper disc and the middle disc of the distributing set is defined an upper third chamber; between the middle disc and the lower cover is defined a lower third chamber in communication with the upper third chamber; the upper disc includes a third inlet to communicate with the upper third chamber; and the lower cover includes a plurality of third inlets to communicate with the lower third chamber.

9. The multi-function shower head as claimed in claim 8 further comprising a vane installed to the lower second chamber and impacted by water in the lower second chamber to rotate automatically in an annular space of the lower second chamber, and the lower cover including a number of watering zones spaced a predetermined angle apart from each other and each watering zone having a plurality of second outlets so that the second outlets of the lower cover are stopped by the rotating vane to generate an intermittent water flow, obtaining massaged water flower.

10. The multi-function shower head as claimed in claim 8 further comprising a spraying member installed in the lower third chamber and including a plurality of nozzles to be inserted in the third outlets so that water in the lower third chamber are sprayed to form water flower after flowing through the nozzles of the spraying member.

11. The multi-function shower head as claimed in claim 1, wherein the rotary positioning means includes a levering pin disposed on the lower end of the holder, a compression spring to abut against the levering pin, and includes a first fixing aperture and a second fixing apertures, both of which are fixed on the top surface of the upper disc to receive the levering pin; as the distributing set is operated to rotate relative to the holder, the levering pin engages with the first fixing aperture, and the distributing set is located at the first rotating position; and when the levering pin engages with the second fixing aperture, the distributing set is located at the second rotating position.

12. The multi-function shower head as claimed in claim 1, wherein the holder includes two symmetrical cavities mounted thereon to receive the two plugs.

13. The multi-function shower head as claimed in claim 1 further comprising an abutting plate including a partition arranged on a middle portion thereof to separate two intakes apart, the upper disc includes a positioning gap disposed around a top end of the first inlet to bias against the abutting plate, such that the abutting plate connects with a top end of the low-flow controlling valve and is biased against the through bore of the plug stably.

14. The multi-function shower head as claimed in claim 1, wherein the lower cover includes at least one levering extension extending outward therefrom to be operated to stop a rotation of the distributing set and the holder relative to each other.

15. The multi-function shower head as claimed in claim 1 further comprising a fixing member and a retaining member; wherein the fixing member includes a plurality of longitudinal cutouts and a longitudinal indentation, the cutout is used to expand a lower end of the fixing member, and the fixing member also includes an annular dent mounted around a lower end thereof; the upper disc includes a lock protrusion disposed thereon to be retained to the indentation so that the distributing set is limited to rotate, the middle disc includes a retaining edge arranged therearound to be retained in the annular dent; the retaining member is fitted to a peripheral side of the fixing member; the holder includes a limiting tab extending outward from a bottom end thereof to be limited between the fixing member and the upper disc so as to rotate relative to the distributing set.

16. The multi-function shower head as claimed in claim 1 further comprising a connecting knob including an entering end to be connected with a water feeding pipe, a spherical exiting end, and an internal passageway communicating with the entering and the exiting ends; and the exiting end couples with the inflow end of the holder.

17. The multi-function shower head as claimed in claim 1 further comprising a housing fitted to the inflow end of the holder to cover the holder and the distributing set.

18. The multi-function shower head as claimed in claim 1 further comprising a seal pad installed between the holder and the upper disc of the distributing set.

19. The multi-function shower head as claimed in claim 16 further comprising a standard flow controlling valve installed in the internal passageway of the connecting knob.

20. The multi-function shower head as claimed in claim 1, wherein the upper disc includes an axial opening mounted at a center thereof to connect with a shaft of the holder so as to form a rotating fulcrum between the upper disc and the holder.

* * * * *